US006412873B1

(12) United States Patent
Harper

(10) Patent No.: US 6,412,873 B1
(45) Date of Patent: Jul. 2, 2002

(54) DRESSING AID FOR INFIRM PATIENTS

(75) Inventor: Morley J. Harper, St. Louis, MO (US)

(73) Assignees: Shamrock Product Development Inc., St. Louis, MO (US); Shamrock Product Development Ltd., Winnipeg (CA)

( * ) Notice: Subject to any disclaimer, the term of this patent is extended or adjusted under 35 U.S.C. 154(b) by 0 days.

(21) Appl. No.: 09/506,804

(22) Filed: Feb. 18, 2000

(51) Int. Cl.[7] ..... A47C 1/12

(52) U.S. Cl. ..... 297/448.1; 297/188.03; 297/188.01

(58) Field of Search ..... 297/217.7, 188.06, 297/188.03, 445.1, 448.1, 452.18, 452.2, 188.01, 188.14

(56) References Cited

U.S. PATENT DOCUMENTS 961,093 A * 6/1910 Astor
3,233,942 A * 2/1966 Creutz
3,310,343 A * 3/1967 Schultz
3,697,127 A * 10/1972 Robertson
4,209,198 A * 6/1980 Apple, Sr.
4,431,206 A * 2/1984 Pryor
4,552,404 A * 11/1985 Congleton
5,641,197 A * 6/1997 Springmann
5,649,742 A * 7/1997 Liu
5,882,067 A * 3/1999 Carbajal et al.

* cited by examiner

*Primary Examiner*—Milton Nelson, Jr.
(74) *Attorney, Agent, or Firm*—Adrian D. Battison; Michael R. Williams; Ryan W. Dupuis

(57) ABSTRACT

The dressing chair is a bedside chair designed especially for elderly people to help them make a safe and easy transition from a prone position in their bed to (including dressing) that point in time at which they are ready to grasp any ambulatory device that they may use to continue with their daily activities. Likewise, it helps them make a safe and easy transition from their ambulatory device to (including undressing) a prone position in their bed, ready for a good nights sleep. The dressing and undressing activities in the aforementioned transitions are made safe by providing a sturdy seat to sit on during certain dressing tasks, and by rails on three sides for grasping during movements, or for leaning against during other dressing tasks. Dressing and undressing are made easy by the combined seat and rail designs which make it easy to transfer from a sitting to a standing position and vice versa, without the need for any artificial lifting devices.

16 Claims, 4 Drawing Sheets

DRESSING AID FOR INFIRM PATIENTS

This invention relates to a dressing aid which can be used by infirm patients to maintain independence in rising from bed and in dressing for daily activities.

BACKGROUND OF THE INVENTION

One of the problems faced by the elderly or otherwise infirm segment of society is that of injury-producing falls while dressing. Elderly or infirm patients often have problems with balance and stability while standing and particularly difficulties in rising from a seated or lying position.

It is highly desirable to maintain the independence and dignity of infirm or elderly patients. More specifically, the activities of getting out of bed, getting dressed, getting undressed and getting into bed provide a number of the most vulnerable activities in which falls or injuries can arise.

Most people who do not have balance problems sit on their edge of their bed while dressing and undressing. When people develop balance problems, it is often recommend that the person use a straight back chair or straight back chair with arms for their dressing and undressing activities rather than the bed. However even the straight back chair is not as safe as necessary since it can topple and since it does not assist the user in rising from the lying or seated position.

SUMMARY OF THE INVENTION

It is one object of the present invention, therefore, to provide an improved dressing aid and method which can be used by an elderly or infirm patient to assist in rising from the bed and dressing to assist the patient in maintaining independence and dignity.

According to a first aspect of the invention there is provided a dressing aid for an infirm patient comprising:

a chair having two sides, a seat bridging the sides onto which the patient can sit and a back rest;

the two side frames each defining two legs for supporting the chair;

the legs being attached to or arranged for attachment to a rigid floor panel to hold the chair against toppling;

each side frame including a top rail spaced at a height above the seat for grasping by the patient while seated and while standing alongside the chair.

Preferably the legs are attached to a flat plate separate from a floor for resting on the floor, the flat plate extending outwardly to side edges spaced outwardly from the legs to an extent to substantially prevent or inhibit sideways toppling of the chair.

Preferably the flat plate extends forwardly and rearwardly from the legs to front and rear edges thereof spaced outwardly from the legs to an extent to substantially prevent or at least inhibit forwards and rearwards toppling of the chair.

Preferably the legs include base flanges arranged for attachment by screws to a floor.

Preferably the top rail of each side frame extends to a forward most position spaced forwardly from a forward edge of the seat.

Preferably the top rail has a length from the forward edge of the seat which is at least equal to the length of the seat from a rear edge thereof to the forward edge thereof.

Preferably the top rail has a length from the forward edge of the seat to the forward most position such that, when the patient is seated on the seat with the legs of the patient over the front edge of the seat between the side frames, the patient can reach forwardly to grasp the top rail at or adjacent the forward most position for pulling the patient from the seat to a standing position.

Preferably the top rail has a height to provide a hand rail which can be grasped by the patient while standing at the side of the chair. Preferably a front leg of each of the side frames extends vertically downwardly from the forward most position.

Preferably the seat rests on a horizontal rail of each side frame spaced downwardly from and parallel to the top rail and bridging front and rear legs of the side frame and wherein an area between the horizontal rails in front of the front edge of the seat is open Preferably there is provided a post with a top receptacle for receiving a hanger of clothes to be worn by the patient.

Preferably the post is mounted on the chair at the back rest so as to stand upwardly therefrom.

Preferably the back rest includes an upwardly facing sleeve portion into which the post is inserted.

Preferably the back rest includes a tubular rail which is bent to form a U-shape with one arm of the U-shape facing upwardly into which the post is inserted.

Preferably the back rest includes a seat back bridging the arms of the U-shaped tubular rail.

According to a second aspect of the invention there is provided a method of assisting an infirm patient in dressing comprising:

providing a chair having two sides, a seat bridging the sides onto which the patient can sit and a back rest, the two side frames each defining two legs for supporting the chair;

attaching the legs to a rigid floor panel to hold the chair against toppling;

locating the chair between a bed of the patient and a closet of the clothes of the patient with the top rail on one side generally parallel to a side of the bed and the top rail on the other side adjacent the closet;

providing on each side frame a top rail spaced at a height above the seat for grasping by the patient while seated;

arranging the top rail on one side such that the patient can grasp the top rail to assist in rising from the bed to a standing position;

and arranging the top rail on the other side such that the patient can grasp the top rail while in a standing position at the closet. Preferably the method includes arranging the top rail of each side frame to extend to a forward most position spaced forwardly from a forward edge of the seat such that, when the patient is seated on the seat with the legs of the patient over the front edge of the seat between the side frames, the patient can reach forwardly to grasp the top rail at or adjacent the forward most position for pulling the patient from the seat to a standing position.

Preferably the method includes providing a post with a top receptacle and transferring a hanger of clothes to be worn by the patient from the closet to the receptacle.

Preferably the post is mounted on the chair at the back rest so as to stand upwardly therefrom.

The device as described in more detail hereinafter therefore resembles a rigid chair structure except that it is rigidly attached to the floor or has its own floor so that it cannot topple and thus provides a firm solid safe support for the elderly or infirm person. When rising from the chair structure, the rigid mounting of the structure prevents or at lest inhibits its toppling in the situation where sudden loss of balance results in a fall by the user against the structure. Thus the device, because of its inherent tip over immunity provides the option of recovering from the fall by offering something solid to grasp or to fall against such as the rail of the seat itself. Because of the large size of the base which extends beyond the legs it is virtually impossible for someone standing inside the rails of the device to get their centre gravity beyond the boundary of the base and cause a toppling action.

The arms extend well forward beyond the seat and are much higher than the arms of a conventional chair so they act as safety rails during movement from the bed to the closet for easy grasping by the patient or as rails to lean against for steadying purposes while standing.

The seat may be pivotally mounted on the frame so that it can be moved up to a raised position to provide more standing room without sacrificing the rigidity and safety of the frame structure.

The forward extended rails allow the user to reach forward to grasp the forward most portion of the rails so that the user can pull forwards to rise to the standing position. Movement from the seating position to the standing position and vice versa may be required for a number of occasions during dressing and undressing and the device therefore significantly improves the safety of the person while undertaking these activities.

BRIEF DESCRIPTION OF THE DRAWINGS

One embodiment of the invention will now be described in conjunction with the accompanying drawings in which.

DETAILED DESCRIPTION

The dressing aid as shown in the figures can be manufactured in different sizes to accommodate different size users or may be adjustable by adjusting the height of the legs and/or the length of the rails for accommodating different users.

Figure 7:
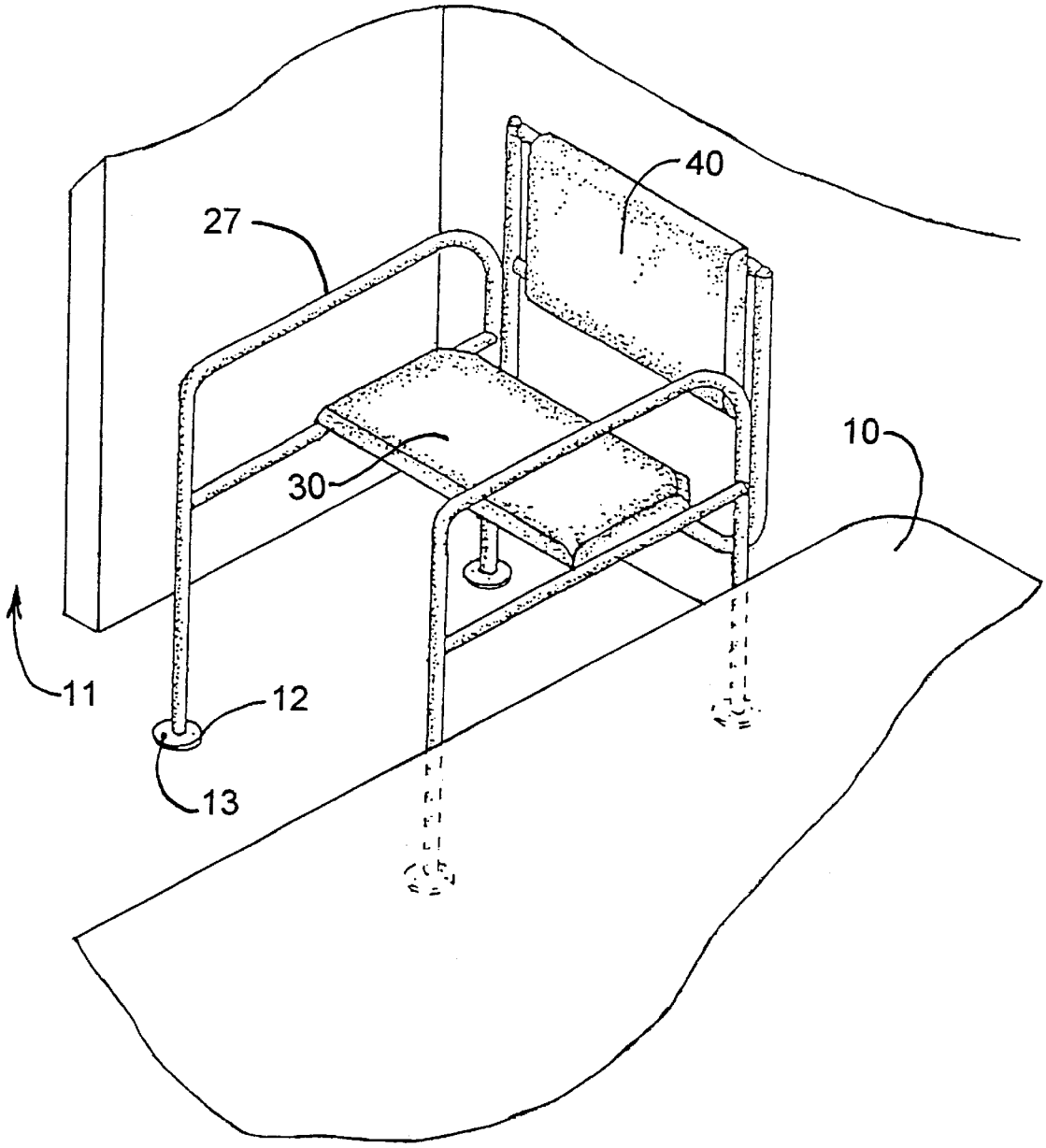
FIG. 7 is an isometric view of the device of FIG. 1 mounted directly on the floor and mounted adjacent a bed and closet for use in the method of assisting the patient.

In FIG. 7 the device is shown between a bed 10 and a closet 11 so that it can be used in a method in which the side rails are grasped by the patient to rise from the bed, to move to a standing position and to manoeuvre between the bed and the closet. In the embodiment shown in FIG. 7, the legs include a bottom flange 12 which is fastened directly to the floor by screws 13.

The bed is located at a position adjacent to the closet and spaced therefrom sufficiently to receive the device between the bed and the closet with sufficient room for the patient to sit on the edge of the bed while rising, to stand between the device and the bed, to stand between the device and the closet and to open the closet for accessing clothes to be used in dressing.

Turning now to the FIGS. 1 through 6, the device comprises generally a chair shaped structure 20 mounted on a horizontal flat base 21. The chair has four legs 22, 23, 24 and 25 which are arranged at four corners of a rectangle and each is spaced inwardly from a respective edge of the base 21 so that the side edges of the base are spaced outwardly from the sides of the legs and the front and rear edges are spaced forwardly and rearwardly respectively of the front and rear of the legs. This provides a base which is relatively large so it is very difficult to cause the base and the device to topple. The legs 22 and 23 form part of a side frame 26 defined by the legs together with a top rail 27. The legs and the top rail are U shaped so that the legs project downwardly to bottom flanges 28 attached to the plate 21. A horizontal cross rail 29 parallel to the top rail 27 joins the legs and thus forms a rigid structure for the side frame.

A padded seat 30 bridges between the horizontal rails 29 with a rear edge 31 adjacent the legs 22 and 25 and a front edge 32 spaced rearwardly from the legs 23 and 24. The seat can be pivotal about a rear pivot axis so that it can lie generally in a plane at the legs 22 and 25.

A rear frame 33 comprises a U shaped member with upstanding arms 34 and 35 together with a bottom horizontal rail 36. The U shaped member is braced by cross rails 37 and 38 with the rail 37 at the top of the arms 34 and 35 and the rail 38 spaced downwardly but above the height of the seat so as to receive between the rails 37 and 38 a padded seat back 40. The seat back thus lies in a vertical plane which is common to the legs 22 and 25.

An upper end of the arms 34 and 35 forms an open tubular mouth or sleeve 41. It will be appreciated that the U shaped members and rails forming the structure are formed from tubular metal so that each can act as a readily graspable rail. The rails are bolted or welded together to form a rigid structure which has sufficient strength to accommodate the forces of the infirm patient leaning vigorously against the structure in the event of a sudden loss of balance.

A mast 45 formed of a rod or tube of smaller diameter than the sleeve 41 is inserted into one or both of the arms 34 and 35 so as to stand upwardly from the back of the chair structure. The rod has a ring or receptacle 46 at its upper end onto which the hook of a clothes hanger can be engaged for hanging the clothes of the patient from the closet prior to dressing in the clothes.

The seat 30 is at a height which is slightly higher than normal so that the patient can lean onto the seat rather than sit down onto the seat since the device is not intended as a resting place but instead as a support to assist in dressing and undressing.

The rails 27 are at a height raised relative to conventional arms of a chair so that they can act as support rails while the patient is standing so that one hand of the patient while standing can grasp the rail to hold the patient steady.

The seat 30 is relatively short in length from its front edge to its rear edge and the front edge is spaced significantly rearwardly from the forward most point of the side rails which is the corner between the horizontal rail 27 and the leg 23, 24. Thus the patient leaning against the seat bottom 30 can move to a standing position by pulling from the front apex.

The chair structure thus has its own floor or is attached to the floor directly so that the presence of the floor panel enables the weight of the user standing within the boundaries of the chair rails to fix the chair to its location so that it is stable and prevent or at least inhibit it from toppling. The base plate is wider than the frame and longer than the frame so as to increase the stability. The large size of the base pad provides significant friction between the floor on which it stands to allow the user to pull themselves to a sitting position on the bed by using the lower rung of the nearest side rail.

The long length of the side rails extending well forward of this front edge of the seat so that the extent of the side rails is approximately double that of the extent of the seat so that there is a free space in front of the seat which is equal in dimension to the size of the seat provides a grasping area in front of the user which is easy to grasp for moving about around the frame and the rails are handy and safe to lean against for steadying purposes when standing.

The fold-up seat can be folded into the raised position to provide extra standing room if necessary during certain dressing tasks. The attachment of the side frames to the floor panel provides a structural stability that is not dependent upon the seat so that the frame will accommodate significant loads should the patient fall against the frame.

The legs may be adjustable in height so that the seat height can be set so that the person resting against the seat has their buttocks above their knees similar to sitting on a kitchen stool to facilitate rising.

Figure 2:
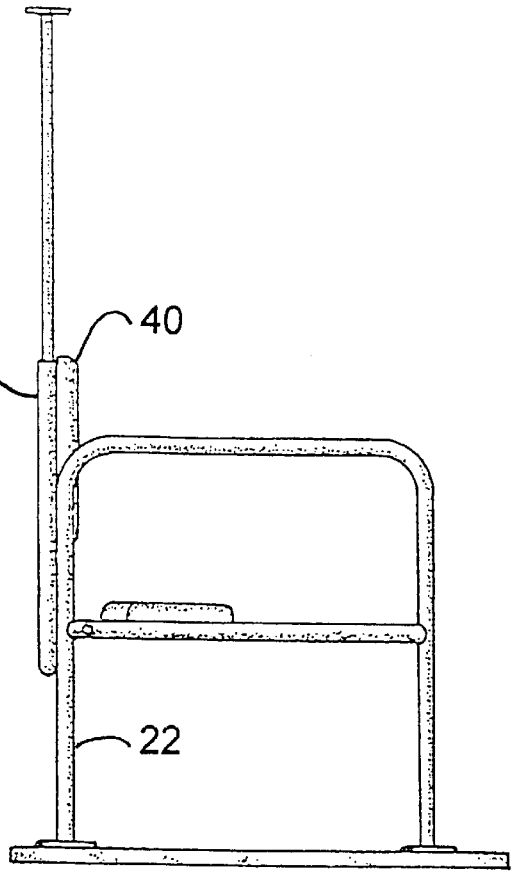
FIG. 2 is a side elevational view of the device of FIG. 1.
Figure 1:
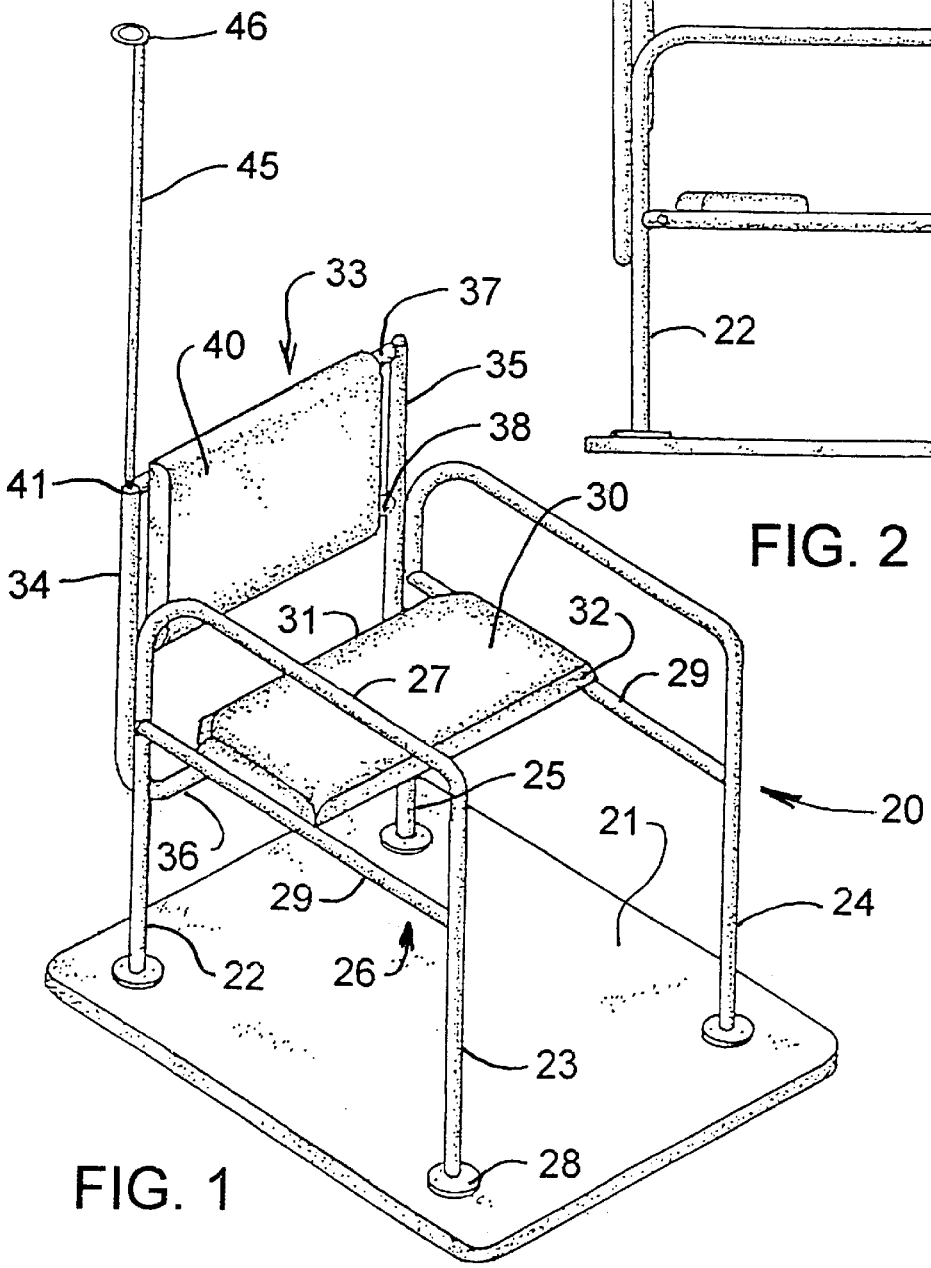
FIG. 1 is an isometric view of the dressing aid according to the present invention.
Figure 3:
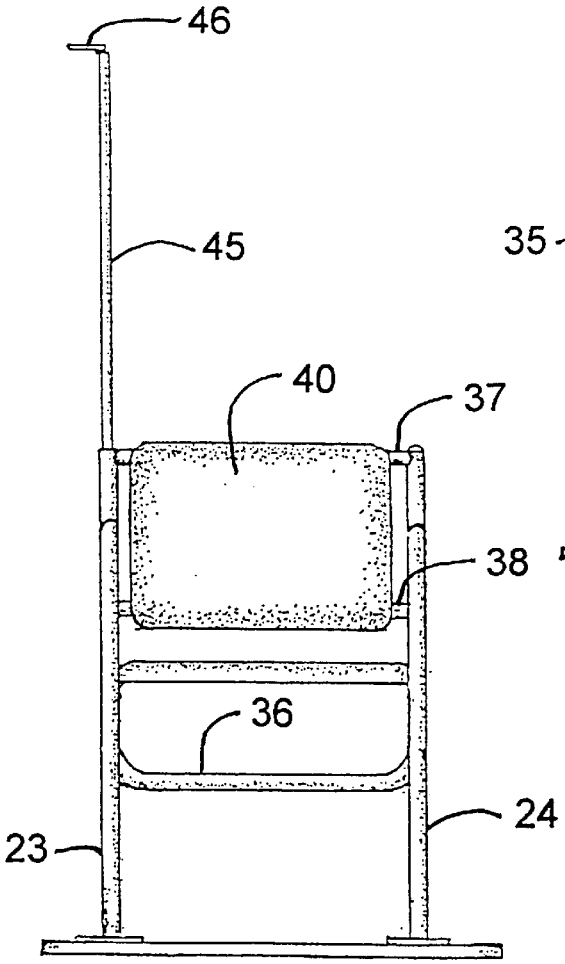
FIG. 3 is a front elevational view of the device of FIG. 1.
Figure 4:
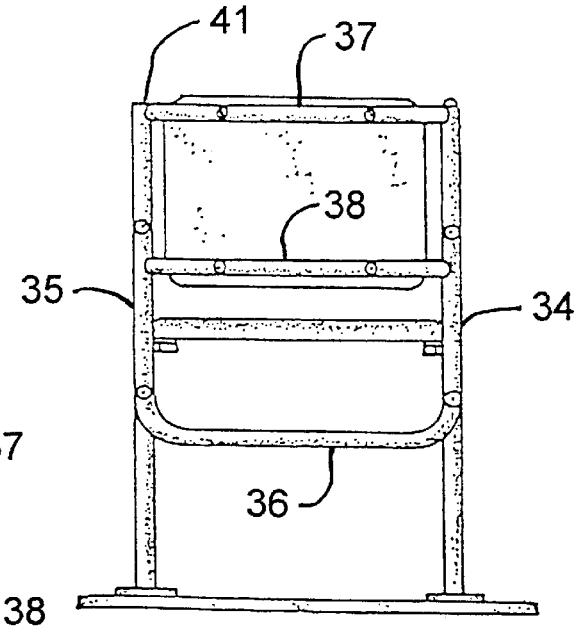
FIG. 4 is a rear elevational view of the device of FIG. 1 with the mast removed.
Figure 5:
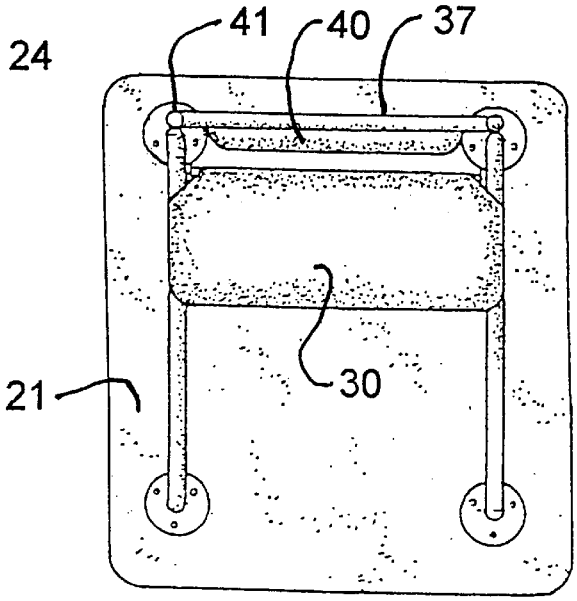
FIG. 5 is a top plan view of the device of FIG. 1.
Figure 6:
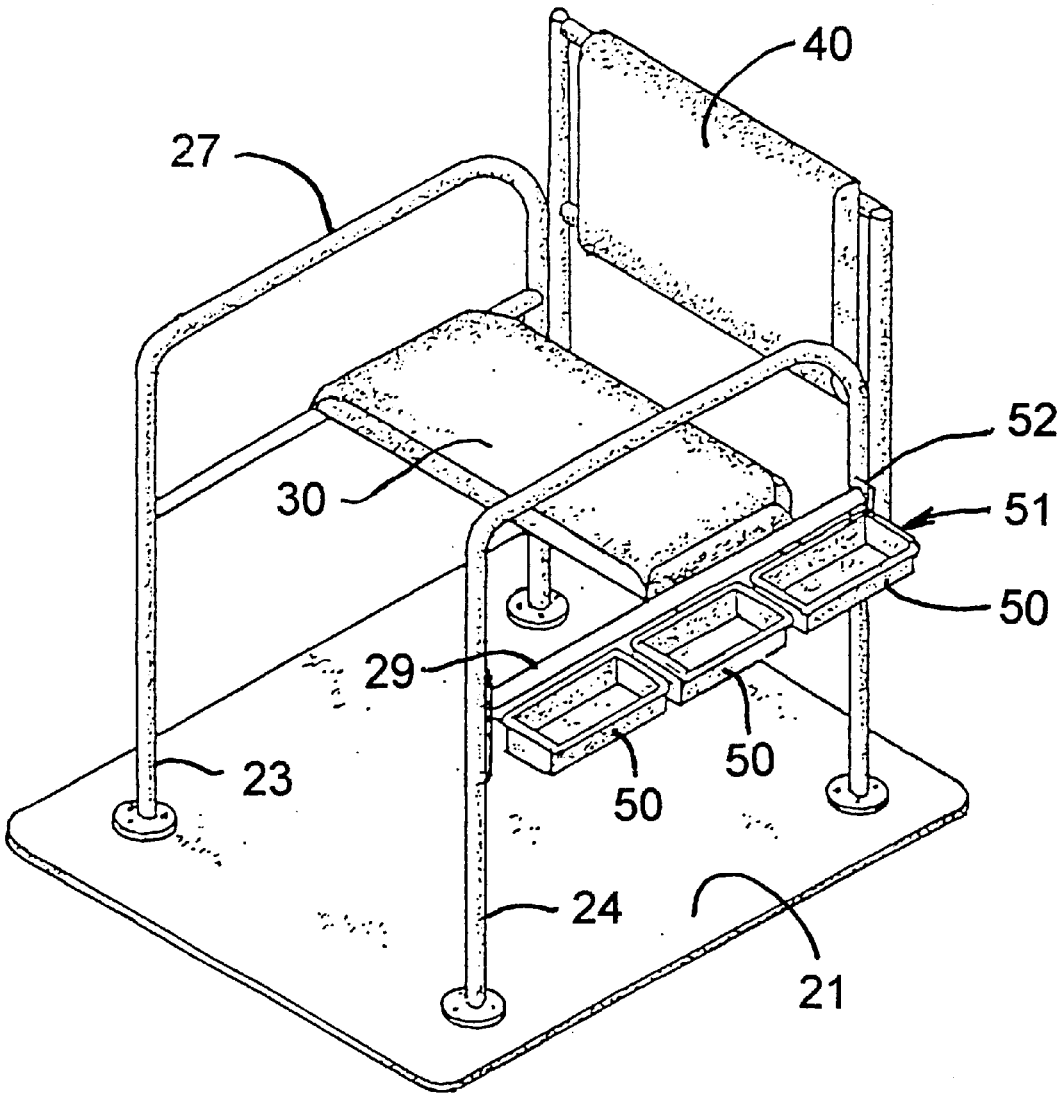
FIG. 6 is an isometric view of the device of FIG. 1 including an additional tray structure for storing small articles.

In FIG. 6 is shown a series of trays 50 connected together into a commonly molded row 51 which is attached by brackets or hangers 52 to the outer side of the side rail 29. The trays thus present open pockets for receiving small items such as change, keys or small articles of apparel which are thus held readily available for the patient directly alongside the patient while seated.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

What is claimed is:

1. A dressing aid for an infirm patient comprising:

a chair having four legs including two legs on one side and two legs on a second side and defining two front legs and two rear legs, a seat bridging the sides onto which the patient can sit and a back rest;

a rigid base panel having a top surface and a bottom surface arranged for resting on a supporting floor surface;

each of the legs having a base attached to the top surface of the rigid base panel to hold the chair against toppling;

each side including a top safety rail spaced at a height above the seat for grasping by the patient while seated and for leaning against by the patient while standing alongside the chair;

wherein at least one of the top safety rails has a length such that the top safety rail extends to a forwardmost position of the top safety rail forwardly of a front edge of the seat;

wherein the rigid base panel extends outwardly from the legs of each of the sides to respective side edges spaced outwardly to an extent to prevent sideways toppling of the chair;

wherein the rigid base panel extends forwardly from the front legs and from the forwardmost position of said at least one top safety rail and from the front edge of the seat to a front edge of the rigid base panel to prevent forwards toppling of the chair; and wherein the rigid base panel extends rearwardly from the rear legs to a rear edge of the rigid base panel to prevent rearwards toppling of the chair.

2. A dressing aid for an infirm patient comprising:

a chair having four legs Including two legs on one side and two legs on a second side and defining two front legs and two rear legs; a seat bridging the sides onto which the patient can sit and a back rest;

each of the legs having a base arranged for attachment to a rigid base structure to hold the chair against toppling;

each side including a top safety rail spaced at a height above the seat for grasping by the patient while seated and for leaning against by the patient while standing alongside the chair;

wherein at least one of the top safety rails has a length from a forward edge of the seat to a forwardmost position of the top safety rail which is at least equal to the length of the seat from a rear edge thereof to the forward edge thereof.

3. The dressing aid according to claim 2 wherein said at least one top safety rail has a length from the forward edge of the seat to the forwardmost position such that, when the patient is seated on the seat with the legs of the patient over the front edge of the seat between the sides, the patient can reach forwardly to grasp said at least one top safety rail at or adjacent the forwardmost position for pulling the patient from the seat to a standing position.

4. The dressing aid according to claim 2 wherein said at least one top safety rail has a height to provide a hand rail which can be grasped by the patient while standing at the side of the chair.

5. The dressing aid according to claim 2 there is provided a rigid base panel having a bottom surface for resting on the ground and a top surface to which the base of the legs is attached, wherein at least one of the top safety rails has a length such that the top safety rail extends to a forwardmost position of the top safety rail forwardly of a front edge of the seat; wherein the rigid base panel extends outwardly from the legs of each of the sides to respective side edges spaced outwardly to an extent to prevent sideways toppling of the chair; wherein the rigid base panel extends forwardly from the front legs and from the forwardmost position of said at least one top safety rail and from the front edge of the seat to a front edge of the rigid base panel to prevent forwards toppling of the chair; and wherein the rigid base panel extends rearwardly from the rear legs to a rear edge of the rigid base panel to prevent rearwards toppling of the chair.

6. A dressing aid for an infirm patient comprising:

a chair having four legs Including two legs on one side and two legs on a second side and defining two front legs and two rear legs; a seat bridging the sides onto which the patient can sit and a back rest;

each of the legs having a base arranged for attachment to a rigid base structure to hold the chair against toppling;

each side including a top safety rail spaced at a height above the seat for grasping by the patient while seated and for leaning against by the patient while standing alongside the chair;

a post with a top receptacle for receiving a hanger of clothes to be worn by the patient;

wherein the back rest includes a tubular rail which is bent to form a U-shape with one arm of the U-shape facing upwardly into which the post is inserted.

7. The dressing aid according to claim 6 wherein the back rest includes a seat back bridging the arms of the U-shaped tubular rail.

8. The dressing aid according to claim 6 wherein there is provided a rigid base panel having a bottom surface for resting on the ground and a top surface to which the base of the legs is attached, wherein at least one of the top safety rails has a length such that the top safety rail extends to a forwardmost position of the top safety rail forwardly of a front edge of the seat; wherein the rigid base panel extends outwardly from the legs of each of the sides to respective side edges spaced outwardly to an extent to prevent sideways toppling of the chair; wherein the rigid base panel extends forwardly from the front legs and from the forwardmost position of said at least one top safety rail and from the front edge of the seat to a front edge of the rigid base panel to prevent forwards toppling of the chair; and wherein the rigid base panel extends rearwardly from the rear legs to a rear edge of the rigid base panel to prevent rearwards toppling of the chair.

9. A method of assisting an infirm patient in dressing comprising:

providing a chair having four legs including two legs on one side and two legs on a second side and defining two front legs and two rear legs, a seat bridging the sides onto which the patient can sit and a back rest;

attaching the legs to a rigid floor structure to hold the chair against toppling;

providing on each side a top safety rail spaced at a height above the seat for grasping by the patient while seated and for leaning against by the patient while standing alongside the chair;

locating the chair between a bed of the patient and a closet of the clothes of the patient with the top safety rail on one side generally parallel to a side of the bed and the top safety rail on the other side adjacent the closet;

arranging the top safety rail on one side such that the patient can grasp the top safety rail to assist in rising from the bed to a standing position;

and arranging the top safety rail on the other side such that the patient can grasp and lean against the top safety rail while in a standing position at the closet.

10. The method according to claim 9 including arranging the top safety rail of each side frame to extend to a forwardmost position spaced forwardly from a forward edge of the seat such that, when the patient is seated on the seat with the legs of the patient over the front edge of the seat between the side frames, the patient can reach forwardly to grasp the top safety rail at or adjacent the forward most position for pulling the patient from the seat to a standing position.

11. The method according to claim 2 wherein there is provided a rigid base panel having a bottom surface for resting on the ground and a top surface to which the base of the legs is attached, wherein at least one of the top safety rails has a length such that the safety rail extends to a forwardmost position of the top safety rail forwardly of a front edge of the seat; wherein the rigid base panel extends outwardly from the legs of each of the sides to respective side edges spaced outwardly to an extent to prevent sideways toppling of the chair, wherein the rigid base panel extends forwardly from the front legs and from the forwardmost position of said at least one top safety rail and from the front edge of the seat to a front edge of the rigid base panel to prevent forwards toppling of the chair; and wherein the rigid base panel extends rearwardly from the rear legs to a rear edge of the rigid base panel to prevent rearwards toppling of the chair.

12. The method according to claim 9 including providing a post with a top receptacle and transferring a hanger of clothes to be worn by the patient from the closet to the receptacle.

13. The method according to claim 9 wherein the post is mounted on the chair at the back rest so as to stand upwardly therefrom.

14. A method of assisting an infirm patient in dressing comprising:

providing a chair having four legs including two legs on one side and two legs on a second side and defining two front legs and two rear legs, a seat bridging the sides onto which the patient can sit and a back rest;

attaching the legs to a rigid base structure to hold the chair against toppling;

providing on each side a top safety rail spaced at a height above the seat for grasping by the patient while seated and for leaning against by the patient while standing alongside the chair;

locating the chair on one side of a bed of the patient with the top safety rail of one side generally parallel to and adjacent to said one side of the bed;

providing on said one side frame a member such that the patient can grasp the member to assist in rising from the bed to a standing position;

and providing a portion of the top safety rail of the side opposite said one side which extends to a position forwardly of a front edge of the seat so as to define an area in front of the front edge of the seat and along side the portion of the side frame;

and arranging the length of the portion and the size of the area such that the patient can stand within the area while holding the portion of said opposite side frame.

15. The method according to claim 14 including arranging the top safety rail of said opposite side frame to extend to a forward most position spaced forwardly from a forward edge of the seat such that, when the patient is seated on the seat with the legs of the patient over the front edge of the seat between the side frames, the patient can reach forwardly to grasp the top safety rail at or adjacent the forward most position for pulling the patient from the seat to a standing position.

16. The method according to claim 14 wherein there is provided a rigid base panel having a bottom surface for resting on the ground and a top surface to which the base of the legs is attached, wherein the rigid base panel extends outwardly from the logs of each of the sides to respective side edges spaced outwardly to an extent to prevent sideways toppling of the chair; wherein the rigid base panel extends forwardly from the front legs and from the front edge of the seat to a front edge of the rigid base panel to prevent forwards toppling of the chair; and wherein the rigid base panel extends rearwardly from the rear legs to a rear edge of the rigid base panel to prevent rearwards toppling of the chair.

* * * * *